US005431134A

United States Patent [19]

Budde et al.

[11] Patent Number: 5,431,134

[45] Date of Patent: Jul. 11, 1995

[54] ENGINE IGNITION TIMING DEVICE

[76] Inventors: William A. Budde, 1128 Gilbert St., Hayward, Calif. 94541; Floyd Knapp, 2451 Tamalpais Ave., Mountain View, Calif. 94043

[21] Appl. No.: 121,268

[22] Filed: Sep. 14, 1993

[51] Int. Cl.[6] ..... F02P 17/00

[52] U.S. Cl. ..... 123/146.5 A; 324/391

[58] Field of Search ..... 123/146.5 A, 595; 324/391, 392; 364/431.04

[56] References Cited

U.S. PATENT DOCUMENTS 4,177,781 12/1979 Marchelletta et al. ..... 123/146.5 A 4,578,755 3/1986 Quinn et al. ..... 324/391 X

*Primary Examiner*—Tony M. Argenbright

*Attorney, Agent, or Firm*—Bruce & McCoy

[57] ABSTRACT

A Harley-Davidson motorcycle engine ignition timing device which electronically determines piston top dead center positioning and the degrees of spark plug ignition before or after TDC to permit dynamic setting and monitoring of the engine ignition timing.

12 Claims, 6 Drawing Sheets

209
203
207
205
201
213
211

ENGINE IGNITION TIMING DEVICE

BACKGROUND OF THE INVENTION

1. FIELD OF THE INVENTION

The present invention relates to internal combustion engine ignition timing devices, and more particularly to a dynamic direct measurement ignition timing device. Still more particularly, the engine timing device of the present invention is especially adapted for determining piston top dead center for setting and monitoring the ignition on Harley-Davidson motorcycle engines.

2. DESCRIPTION OF THE PRIOR ART

The Harley is an exasperating beast. For something that has been around for so long, there has been remarkably little refinement. One of the hardest things to do properly is to set the ignition timing without an extended trial and error sequence. Top dead center (TDC) and ignition timing are usually marked on the flywheel of the Harley engine. There is an inspection port which can be opened by removing a plug to permit observation of the ignition timing or TDC marks if the conditions are favorable. Unfortunately, oil and dirt permeate the flywheel environment. Even more frustrating, until the 1993 model, the view port and timing marks of a Harley were located on the opposite side of the motorcycle from the position where the ignition unit, which needs to be adjusted for proper timing, is secured to the engine. A mechanic must repeatedly switch from one side of the machine to the other in the trial and error sequence required to set the electronic ignition, ignition breaker points, or to position the magneto or distributor in relation to the TDC or timing marks.

There is a mechanically-based after market device which addresses the problem for only the points actuated model Harley ignitions. It permits the timing marks which normally reside on the fly-wheel, or other pulley which is attached to the crankshaft, to be placed on the camshaft. This, in effect, transfers the timing marks to the opposite side of the engine whereby they are on the same side of the machine as the ignition unit to facilitate adjusting the timing. This device is purely mechanical and the transfer of information to the opposite side of the engine is the sole advantage and benefit of its use. It does not eliminate the trial and error method of setting the ignition timing.

In order to overcome the lack of correlation problem, and to facilitate the accurate setting of the ignition timing in a simpler manner and under true operating conditions rather than by trial and error, it is necessary to provide an engine monitor which does not require major modifications to the motorcycle. However, sensing any type of mark on a motorcycle engine flywheel with an optical-type sensor has several problems. The view port is too small to see much of the flywheel at any time, and oil and dirt quickly obscure the mark. Obviously the inspection port could be opened and the mark repeatedly cleaned, but this is too great of a hindrance and would prevent the utilization of a universal optical sensor for all of the different models of Harley motorcycles.

Likewise, modifying the flywheel of an engine so that an electronic sensor could detect the position of the TDC mark is not really practical. Such a monitor would require an extensive modification that is usually not justifiable. For example, a magnetic/reluctance type pickup that would respond to a TDC mark on a flywheel could be utilized, but there are too many older engines that have beaten up flywheels, and the balancing and drilling which would be required would interfere with reliable operation of the engine. More importantly, however, most owners would not stand the expense or work required to disassemble the engine to add the indicator to the flywheel.

As a result, after much consideration and experimentation, it has been determined that the most practical solution to the problem of setting Harley ignition timing is to obtain the TDC indication from a pickup device mounted on the camshaft, magneto shaft, or distributor shaft in the "nose cone" that houses the Harley ignition unit, either points or electronic, and which is driven from the camshaft. To provide a practical and mechanically simple embodiment of the invention, many options had to be explored. The choices were mechanical (switch or points), magnetic/reluctance, or optical. The use of a magnetic or reluctance-type sensor was considered but that approach was determined to be less desirable because of interference problems with the magnetic ignition sensor and false signals induced by the standard "point type" ignition system.

SUMMARY OF THE INVENTION

The present invention is an ignition timing device specifically designed for setting the spark advance on Harley-Davidson motorcycle engines utilizing a spark plug ignition system which is housed in a nose cone and is driven by an ignition drive shaft. It comprises a TDC sensor which generates an electronic signal when the engine crankshaft is positioned so that a selected piston is at TDC. An ignition firing sensor is provided for determining when the spark plug associated with that piston fires and for generating an electronic signal to indicate the firing. A timer is provided for determining the rotational time of the engine and a computer unit is provided for integrating the electronic signals from the TDC sensor and the ignition firing sensor and the timer for determining the time of ignition relative to the engine rotational TDC and calculating the difference therebetween and converting the difference to degrees of crankshaft rotation before or after TDC. A display indicates the difference in degrees of rotation.

The TDC sensor which is utilized is appropriate to the type of ignition system used on the individual machine and generates an electronic signal when the crankshaft is positioned so that a selected piston is at TDC. Any piston can be referenced. TDC is located relative to the drive shaft for the ignition system and the electronic apparatus for generating the TDC signal is keyed to the TDC relation to the ignition drive shaft.

The ignition firing sensor can be one of several types but the sensor is typically an inductive pickup on the spark plug wire although this signal can also be derived from the functioning of the ignition coil.

The RPM and rotational time of the engine is determined by the timer and the computer. The difference in crankshaft rotation between ignition firing relative to TDC is calculated by the computer and displayed in degrees of crankshaft rotation before or after TDC by an LED or LCD type of display. These timing measurements and the calculation of degrees of rotation can be made using analog circuitry but in the preferred embodiment, digital circuitry is employed.

Mechanically, the problem is to provide apparatus that allows only minor and inexpensive modifications to the ignition points, or electronics for a magnetic or optical pickup mechanism, that would generate the required signal for a timing device. The invention can also be adapted to perform additional useful tasks such as indicate engine RPM and ignition dwell, and monitor various engine temperatures and battery voltage.

For the electronic or magnetic sensor ignition systems, an optical sensor is utilized to determine TDC because of mechanical simplicity and the clean environment. A magneto ignition system can use the same optical TDC sensor that the magnetic sensor ignition system uses. The mechanical point type distributor ignition systems, on the other hand, have a space problem that precludes the use of an optical sensor. The mechanical advance mechanism occupies all of the space below the breaker plate and there is no room above the breaker plate. The fact that many Harley-Davidson owners have added fancy nose cone cover plates made it evident that a cup-shaped cover plate to gain extra room could not be used. To solve the problem, a replacement breaker plate is provided for the standard breaker point ignitions and a second set of points are mounted on it to function as the TDC signal generator.

OBJECTS OF THE INVENTION

It is therefore an important object of the present invention to provide an engine ignition timing device which will produce an electronic determination of TDC in all types of Harley-Davidson motorcycle engines.

It is another object of the present invention to provide an engine ignition timing and monitoring device for Harley-Davidson motorcycle engines which is not dependent upon sensing the TDC marking on the flywheel of the engine.

It is a further object of the present invention to provide an engine ignition timing and monitoring device for Harley-Davidson motorcycle engines which can be utilized on all of the different types of Harley ignition systems with only minor and inexpensive additions and modifications to the machines.

It is still another object of the present invention to provide an engine ignition timing and monitoring device for Harley-Davidson motorcycle engines which can be mounted permanently on a motorcycle and, in addition to constantly monitoring ignition timing, can display RPM, battery voltage, and various engine temperatures as well as other functions.

It is yet a further object of the present invention to provide an engine ignition timing device for Harley-Davidson motorcycle engines which responds to the ignition firing and generates an indication of the number of crankshaft rotational degrees between TDC and the ignition firing point.

It is yet another object of the present invention to provide an engine ignition timing device for Harley-Davidson motorcycle engines which will function with both dual-fire (standard) ignition systems and single fire (after market modification) ignition systems.

Other objects and advantages of the present invention will become apparent when the apparatus of the present invention is considered in conjunction with the accompanying drawings.

DESCRIPTION OF THE PREFERRED EMBODIMENT

Figure 1:
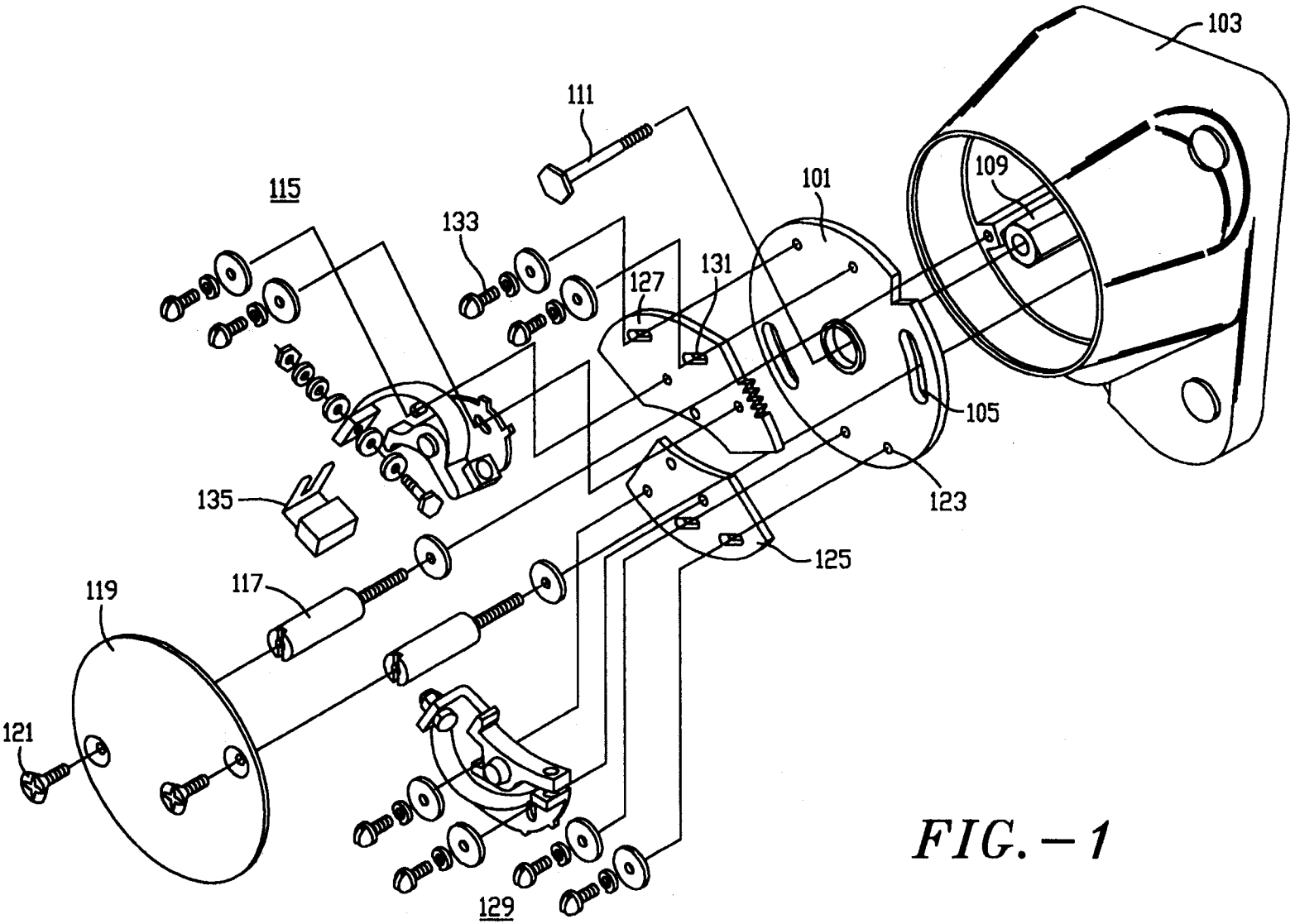
FIG. 1 is an exploded perspective view of a first embodiment of a sensor for the present invention.

Reference is made to the drawings for a description of the preferred embodiment of the present invention wherein like reference numbers represent like elements on corresponding views.

THE ENVIRONMENT

In order to set the ignition on any spark plug fired internal combustion engine, two pieces of data are required. It is necessary to determine top dead center (TDC) of the piston compression stroke and the ignition firing of the associated spark plug in relation to TDC. The measurement must indicate, in increments of degrees, when the spark plug firing occurs in relation to "before or after" TDC, then the ignition setting can be changed to set the proper degrees of spark advance.

Apart from removing a spark plug and eyeballing, TDC in a Harley engine can be most easily determined mechanically from two indicators. In addition to the view port for the TDC mark on the flywheel, there is a cam lobe on the ignition drive shaft which will pinpoint TDC. As a result, there are additional ways to determine TDC in a Harley by utilizing an accessory sensor working in conjunction with the ignition drive shaft.

To determine spark advance in relation to a known TDC, an inductive pickup, such as is used on automotive strobe timing lights, is utilized to determine when the spark plug fires. Similarly, one could look at the operation of the ignition coil for this information, but there are too many different types of ignition systems in use on Harleys, and the inductive pickup works equally well with all of them.

The different types of spark plug ignition systems on Harley-Davidson motorcycles include magnetos, magnetic electronic ignitions, and distributor ignition systems with mechanical breaker points and condenser. The ignition initiating device and mechanical spark advancement mechanisms of these ignition systems are housed in a nose cone mounted on the engine. In the original Harley points and condenser ignition system, the timing plate that holds the points, called a breaker plate, is bolted inside of the nose cone, and the timing is adjusted by rotating the breaker plate with respect to the nose cone to set the degrees of spark advance.

THE MECHANICS

The operation of the engine ignition timing device of the present invention combines the characteristics of a tachometer and the performance of a computer for calculating time and physical displacement for determining ignition timing in degrees of rotation. In all forms of the present invention, the additions and modifications to the ignition systems for sensing TDC in the engine are timed from the ignition drive shaft, and the additions required for the nose cone ignitions are all designed to be placed therein or are made to the components of the ignition system contained therein.

While the electronic portions of the engine monitor and analyzer of the invention are the same for each embodiment of the invention, several different forms of the mechanical elements are utilized, as well as different electronic sensors in those forms, in order to accommodate the variation in the different ignition systems which are used on Harleys.

First Form—FIG. 1

Reference is made to FIG. 1 of the drawings for an understanding of the first alternative form of the improvement invention. This embodiment is used for distributor ignition systems with mechanical breaker points and condenser.

A partially rotatable base plate 101 is mounted in the ignition nose cone 103, and TDC is determined mechanically as described hereinafter at which point the base plate is secured in position (fixed) with the piston known TDC thereafter determined by the position of that plate. The base plate is provided with arcuate slots 105 through which the securement bolts for the plate project to engage the nose cone. The slots allow partial rotation of the base plate with respect to the nose cone to accommodate a wide range of different piston stroke engines.

The ignition camshaft 109, which is secured to the ignition drive shaft from the engine by a camshaft bolt 111, projects through a hole 113 in the center of the base plate 101. The fly weights (not shown) and the camshaft are all stock and still function in the same manner as before to actuate the ignition points 115 mounted on the base plate.

The base plate 101 is secured to the nose cone 103 with standoff bolts 117 which are provided with slotted and tapped heads which permit the bolts to be tightened by a screwdriver. The standoff bolts permit a cover plate 119 to be mounted at the top ends thereof and secured thereto by screws 121 which engage the tapped bolt heads. Tapped holes 123 are formed in the base plate for the securement of two breaker plates 125, 127 to the base plate.

One set of breaker points 129 is an accessory set of points simply for determining the TDC reference point and do not function as the breaker points for the ignition system. The accessory points are mounted on a first breaker plate 125 which is also partially rotatable with respect to its mounting on the base plate to provide additional adjustment to accommodate different stroke engines.

The accessory breaker points 129 are secured to the base plate 101 and the engine is set at TDC. The base plate is rotated until the points start to open and provide an electronic signal at which point the base plate is secured to the nose cone 103 thereby referencing TDC with the accessory points. The electronics of the invention thereafter use the accessory points, which are now fixed in position to open at TDC, for continuously determining the TDC reference and the angle of ignition advance.

The ignition breaker points 115 are mounted on a second breaker plate 127 which can also be partially rotated with respect to the fixed base plate 101 for the purpose of setting spark advance as a result of the arcuate slots 131 for the mounting screws 133. As a result of the independent breaker plates 127, 129, the two sets of points are individually partially angularly adjustable around the ignition camshaft on the base plate 101.

Since TDC is known from the base plate 101 and the accessory points 129, that information can be used electronically as a reference for the purpose of determining the degrees of advance based on the rotation of the second breaker plate 127 with respect to the base plate to which it is secured. The ignition points 115 provide the spark advance and retard function and delivery of the ignition spark to the plugs based on the positioning of the second breaker plate with respect to TDC as measured by the accessory points and the electronic equipment.

The condenser normally required for a breaker point ignition is no longer mounted on the breaker plate as with the original equipment. It can be moved to the coil, or an after market more modern type condenser 135, with different packaging, can be mounted on the new fixed base plate 101 or directly on the movable point assembly 115 of the second breaker plate 127.

Figure 2:
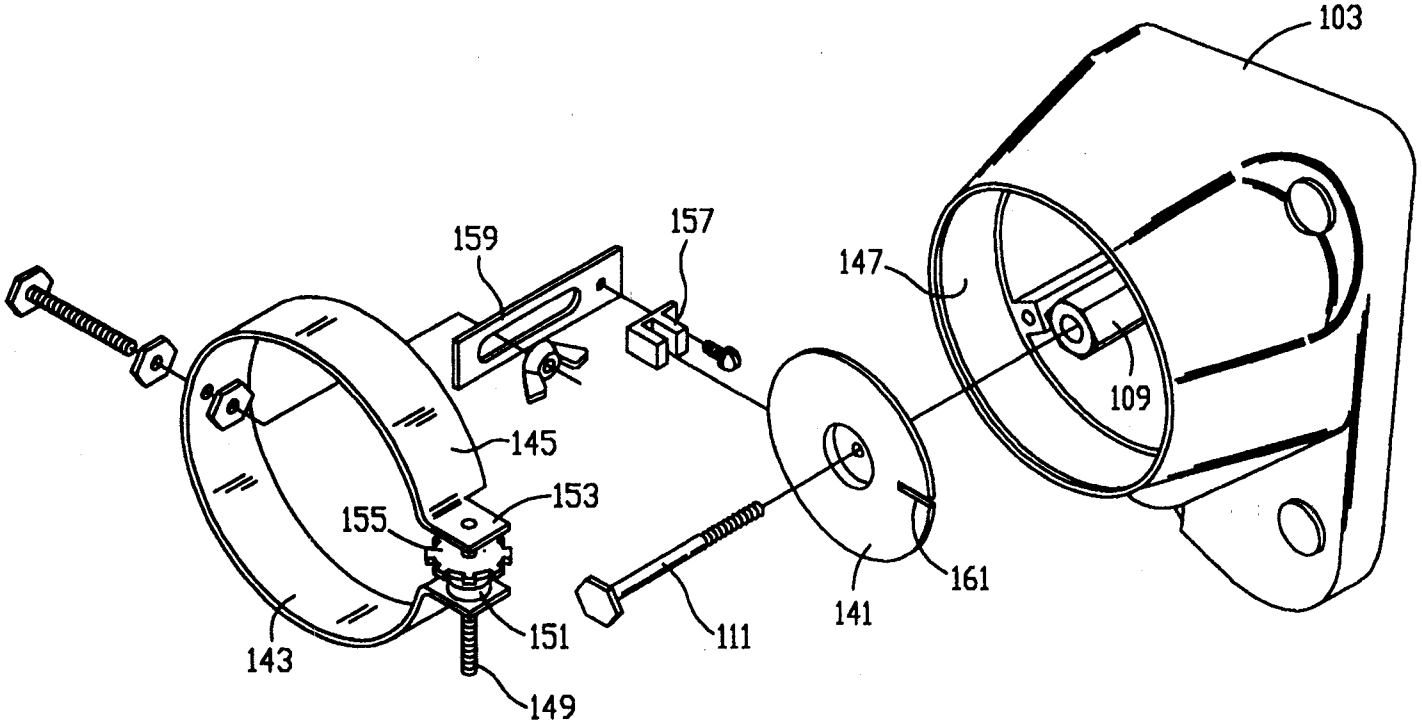
FIG. 2 is an exploded perspective view of a second embodiment of a sensor for the present invention.

Second Form—FIG. 2

Reference is made to FIG. 2 of the drawings for an understanding of the second alternative embodiment of the invention which is a universal shop timing unit. It provides a readout until the timing is set, and then a major portion of it is removed from the motorcycle. It determines TDC by the use of an optical system which requires placing a timing disk 141 on the ignition drive shaft secured by the camshaft bolt 111 and inserting internally into the nose cone 103 an expandable split ring 143 which can be rotated with respect to the nose cone for the purpose of setting ignition. Once the TDC has been located, and the ignition has been set by use of the analyzer, the optical interrupter apparatus, except for the timing disk, is taken out of the nose cone and removed from the motorcycle.

The expandable split ring 143 has a skirt 145 on the lower end thereof which engages the internal outboard edge 147 of the annular cavity of the nose cone 103. A standard screw 149 engages a threaded collar 151 secured to one end of the split ring while the end of the screw shaft bears against the other end 153 of the split ring in an indentation which locates the end of the screw. A wheel actuator 155 for the screw shaft is secured thereto to permit turning the shaft to move it in the collar and expand and contract the ring.

The expandable ring 143 has an adjustable optical interrupter sensor 157 secured thereto by a mounting bracket 159. The interrupter sensor projects into the nose cone cavity for the purpose of bracketing both sides of the disk. The disk has a radial slot 161 formed therein to permit the passage of optical radiation from the emitter side of the sensor to the detector side of the sensor.

The engine is set at TDC or it is determined accurately from the ignition drive shaft, and then the slot in the disk is oriented with respect to the sensors at TDC from which point the advance or retard of the original ignition points breaker plate, which is still used, can be determined. The optical sensors signal TDC with each revolution of the camshaft while the ignition firing sensor signals sparkplug firing, and the electronics of the invention indicate spark advance or retard from TDC whereby the breaker plate can be rotated to adjust the spark advance to the recommended setting.

The universal split ring adapter is used simply for the purpose of determining TDC and requires only the permanent insertion of the disk into the ignition system. Once the spark advance has been set in the ignition system, the expandable ring and sensors must be removed for normal operation of the motorcycle. Since the universal device is a shop tool, it does not provide data from which to provide a continuous readout or monitoring on the motorcycle as with the other embodiments.

Figure 3:
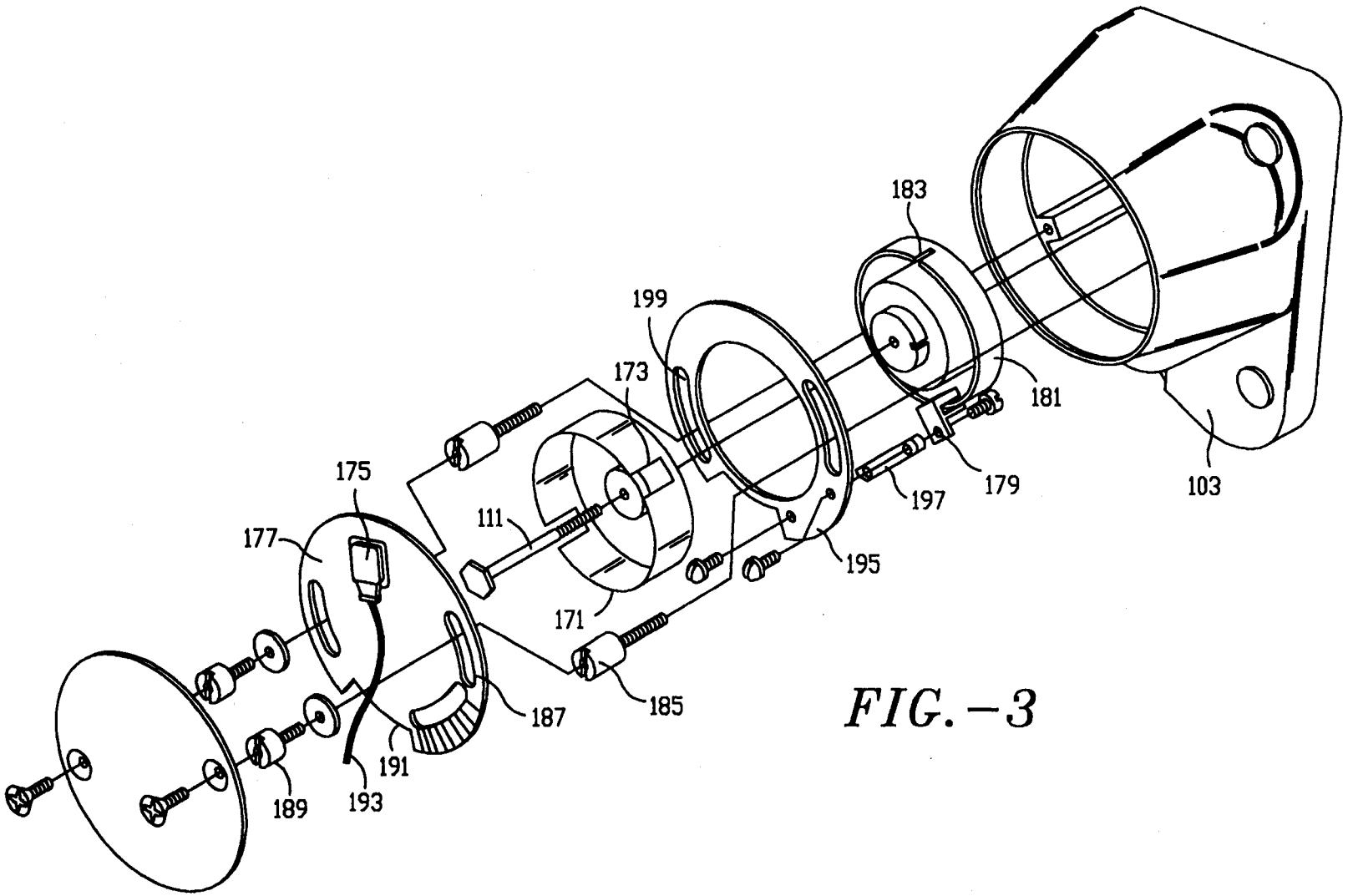
FIG. 3 is an exploded perspective view of a third embodiment of a sensor for the present invention.

Third Form—FIG. 3

Reference is made to FIG. 3 of the drawings for an understanding of the third alternative embodiment of the invention as used for modern electronic type ignitions.

The standard modern Harley electronic ignition is a magnetic/reluctance unit that uses a timing cup 171 which is mounted to the ignition drive shaft and oriented by placement marks. Gaps 173 are provided in the walls of the ignition timing cup to permit the magnetic sensor to sense the magnet mounted on the sensor plate and disposed inside the periphery of the timing cup. The magnetic sensor 175 is mounted on a partially rotatable base plate 177 and brackets both sides of the cup wall. The magnetic sensor utilizes the Hall effect for the purpose of determining the non-existence of a ferrous metal presence which is a gap in the wall of the ignition timing cup. The sensor responds to a magnetic field which is normally blocked by the cup. When the gap in the wall of the cup is positioned in front of the sensor, it allows the magnetic field to exist across the space in the cup to the receptor sensor which is closely positioned on the opposite side of the wall of the cup. The two gaps in the cup wall are irregularly spaced around the periphery thereof for the purpose of firing the two different cylinders at the specified different times. This is stock factory equipment. A notch provided in the ignition drive shaft is an indexing reference for the alignment of the cup.

In adapting an accessory optical TDC sensor 179 to the standard electronic ignition, the stock sensor base plate 177 with the Hall effect device 175 and the ignition timing cup 171 are moved further outboard in the Harley ignition nose cone 103. An accessory TDC timing cup 181 is mounted to the inner end of the ignition drive shaft and has a slot 183 formed in its wall which is the TDC timing mark. The accessory timing cup is "keyed" to the ignition drive shaft, providing accurate registration for the timing cup.

In the preferred embodiment of the present invention, the standard sensor plate 177 is mounted outboard within the nose cone on stand off bolts 185 having slotted and tapped heads which position the sensor plate with respect to the ignition timing cup 171. The base plate 177 for the magnetic sensor 175 has arcuate slots 187 for the mounting bolts 189 which screw into the standoff bolts 185. The base plate 177 can be rotated with respect to the nose cone housing 103 for the purpose of advancing and retarding the spark. The spark is generated by the electronic ignition unit receiving a signal from the magnetic sensor 175 and initiating the spark in the coil and sending it to the plugs based on the signal from the sensor.

A modification has been made to the original base plate 177, which mounts the Hall effect sensor, in the form of a notch 191 at the periphery of the plate for the purpose of allowing the ignition wires 193 to exit the same hole in the side of the nose cone 103 at a lower level with respect to the new outboard position of the electronic sensing plate 177 in the nose cone.

The accessory optical signal generator and receptor unit 179 is mounted on an adapter ring 195 secured inside of the nose cone 103 inboard of the standard base plate 177. The sensor unit brackets both sides of the TDC timing cup 181 to sense the slot 183 formed in the wall thereof. The optical sensor unit is secured to the adopter ring by a spacer 197.

The TDC signal is generated when the gap 183 in the timing cup wall 181 allows optical radiation to pass from one side of the sensor unit 179 to the other. The response time of the sensor is known from published technical books and that response time is factored into the calculations. The output from the optical sensor unit is used for providing the signal to the electronics whereby the advance and retard can be measured against the TDC signaled or indicated by the accessory timing cup and optical sensor.

The adaptor ring 195 which has been inserted for the purpose of mounting the TDC sensor 179 is provided with arcuate slots 199 for the purpose of accommodating a wide range of different piston stroke engines. Once the accessory TDC sensor parts 179, 181 have been installed, and the original ignition timing cup 171 and magnetic sensor 175 have been reinserted outboard in the nose cone 103, the added-on sensor generates a TDC signal for the electronics, and the original base plate 177 can be rotated to set the spark advance in the same manner as with the original equipment.

Figures 4, 4A, 4B, 4C:
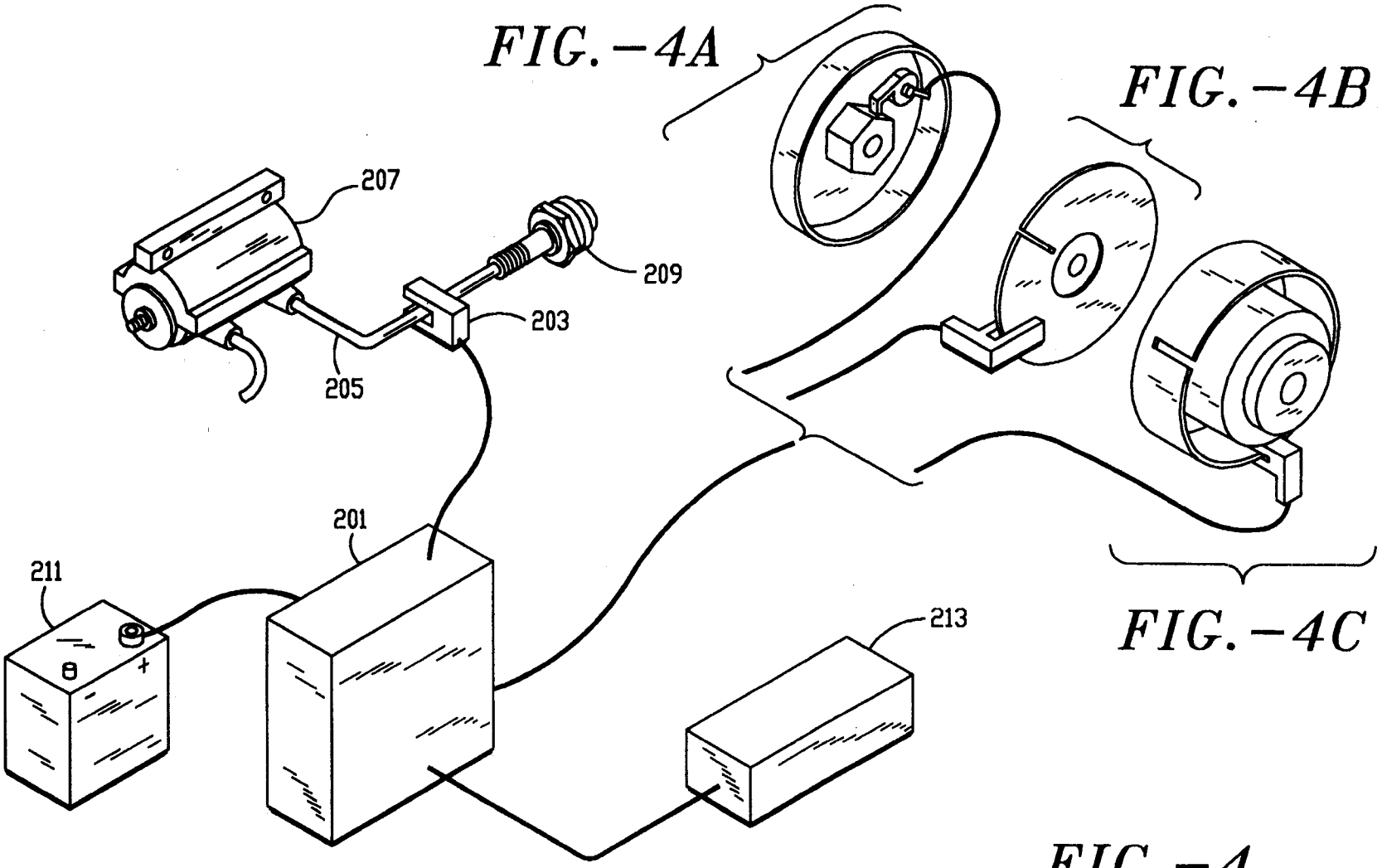
FIG. 4 is a diagram of the hardware and electronics of the present invention.
FIG. 4A is an illustration of the TDC sensor of the first embodiment of the present invention.
FIG. 4B is an illustration of the TDC sensor of the second embodiment of the present invention.
FIG. 4C is an illustration of the TDC sensor of the third embodiment of the present invention.

Hardware Diagram—FIG. 4

Reference is made to FIG. 4 of the drawings for the hardware and electronics hookup of the present invention. The diagrams are identical for all three embodiments of the invention except for the illustrations of the TDC sensors: FIG. 4A illustrates the accessory points of the first embodiment of the invention for distributor ignition systems utilizing mechanical breaker points and condenser; FIG. 4B illustrates the removable optical sensor of the second embodiment of the invention for a universal shop timing unit; and FIG. 4C illustrates the accessory optical sensor of the third embodiment of the invention for use with modern electronic type ignitions. The TDC sensors deliver an electronic signal to the timer/microprocessor combination 201.

All embodiments include an ignition firing sensor 203 or inductive pickup for determining when the spark plug associated with the selected TDC piston fires and for generating an electronic signal to indicate said firing. The inductive pickup of the sensor is placed on the spark plug wire 205 running from the coil 207 to the spark plug 209 of the cylinder in which TDC is sensed, and the electronic signal produced by the pickup is delivered to the timer/microprocessor combination which is battery powered 211. The timer/microprocessor delivers its output signal to a spark advance display 213.

THE SENSORS

The TDC indication obtained from the mechanical additions to the nose cone is used to measure the time of engine or crankshaft rotation based on the engine speed. This time measurement is then divided to determine the amount of time required for each degree of rotation at that speed. The time of ignition relative to the time of engine rotation is determined from the sparkplug ignition sensor, and that figure is then used to calculate the number of degrees relative to TDC that ignition occurs, either plus or minus. There is no need for any scales or interpolation between marks to establish the firing angle as is done presently.

The response time of the sensor and electronics combined result in an error of only 0.5 degrees shift in the direction of rotation at 10,000 RPM. This degree of accuracy, so far above the 8000 RPM limit of a normal engine operation, makes it very acceptable. Since this error is a constant, it is removed during calculations. At 1,000 RPM the calculated error is only ±0.01 degree, well within any required specification.

Static timing or setting of the TDC sensor is accomplished manually, with the aid of a built-in LED indicator, and the same procedure is used for each embodiment of the invention. The engine is rotated in its proper direction and stopped at the mechanically determined TDC location indicated on the flywheel or by other methods. Then the TDC sensor is positioned to where the TDC indicating LED just comes on. This process removes mechanical error by not reversing engine rotation, or "backing up the engine."

The signal from the TDC sensor is also used to drive an external optional TDC indicator line by grounding the line. This TDC signal is referred to as "edge sensitive" and is of a short duration, especially when using an optical sensor, but the duration of the TDC signal is not critical. This external line can be used to turn on and off an external 12-volt bulb or any other indicator as an aid for setting the TDC sensor. The setting of the TDC reference is accomplished only initially and does not interfere with normal setting of the timing.

THE ELECTRONICS

The purpose of the timing device of the present invention is to determine TDC of the engine electronically and to then measure the firing of the coil in relation to the position of the piston with respect to TDC and then to provide a read out which permits adjustment or monitoring of the ignition timing based on the electronic read out indicated by the device.

The approach used to implement this invention can be done in a purely analog or purely digital manner or a mixture of both. For the purpose of providing the most compact embodiment of the invention, a predominantly digital approach is utilized. This allows greater flexibility and the elimination of the usually necessary hardware "tweaking." All "tweaking" is done in the software.

The electronics are based on a high integration microprocessor 201. A first input which is the reference signal from the TDC sensor has two uses: first is the indication of the exact instant of the selected piston reaching TDC; and the second use is to determine crankshaft rotational time. Crankshaft rotational time is the time measurement between sequential TDC signals divided in half. The crankshaft rotates twice as fast as the ignition camshaft. The crankshaft rotational time is used to determine how much time is allotted for each degree of crankshaft rotation.

A second input signals the actual firing of the spark plug. The inductive pickup 203 provides the second input signal, which is the real timing of when the plug actually fires, giving a true timing signal. This establishes the real time relationship to TDC which can be numerically expressed as the degrees before or after TDC that ignition occurred. All of this is simply mathematics that are run in the computer, and the information can be displayed in many different formats. Additionally, a second firing input is available for use on what is referred to as a "Single Fire" ignition system; a normal Harley-Davidson uses "Dual Fire" ignition in that both plugs are fired simultaneously. The second firing input is needed for information to measure and calculate #2 cylinder firing angle when used with a "Single Fire" ignition system.

THE DISPLAY

A very minimal embodiment of the invention would include a three-digit LED array that would display both the RPM or the degrees of ignition advance dependent upon a switch to flip between one mode or the other. Alternatively, a display can be provided to have enough digits to display all the information simultaneously. A fancier embodiment could have a liquid crystal display panel and display not only the spark advance information but all the other additional available information such as ignition dwell, uncertainty in the timing, RPM, battery voltage and, with the necessary thermocouples and heat sensors, the various engine temperatures such as oil, transmission, and cylinder head. The uncertainty in the timing indicates how much variance there is between sequential firing points so one can have information as to how steady the timing is. This information is available from the timing sensors and can be displayed.

As to which of the foregoing information that is collected is to be displayed, it is a function of economics of the invention's particular application. It is foreseen that some applications will be for a limited physical size and will necessitate the display being switched between RPM and firing angle. Others will have the luxury of being able to present simultaneously all of the data that has been collected and distilled from analysis.

For simplicity, the information can be displayed as a three-digit number. When showing RPM, the number is multiplied by 10 for a true reading. When timing advance degrees are displayed, the format is XX.X, in tenths of a degree, with an indication as to before or after TDC. The information that is generated, however, includes more than just these two figures, it includes the averaging of the timing over a period of time to remove variations induced by the mechanical ignition, the measurement of variation from firing to firing, and the fluctuation of the RPM. In a form for use in a service shop, all this information is presented for evaluation and diagnosis. For continued operation as an instrument on the bike only, RPM and degrees of firing are of primary interest and therefore presented. These two pieces of data can be displayed simultaneously or alternately as controlled by a switch. The physical size of the electronics is small enough to be put into such a small volume that the size of the final embodiment is controlled by the size of the display.

THE PERFORMANCE PROGRAM

Figure 5A:
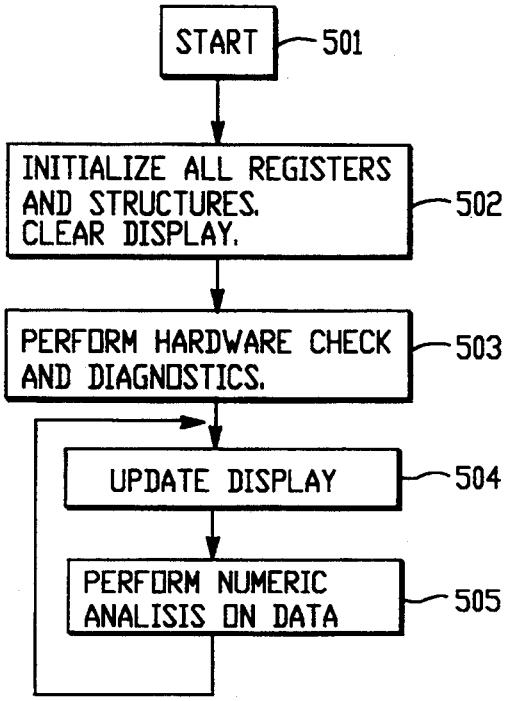
FIG. 5A–C are firmware functional flow diagrams for the minimum performance computer programs of the present invention.
Figure 5B:
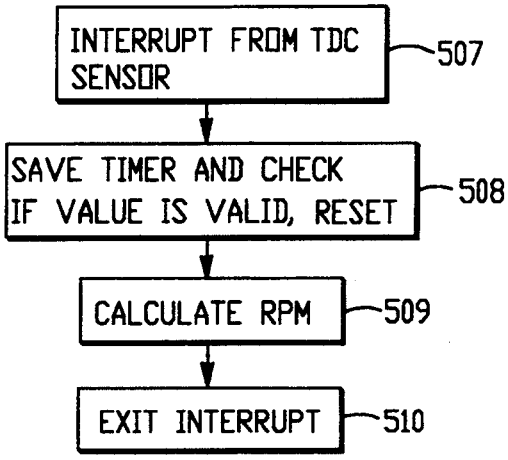
Figure 5C:
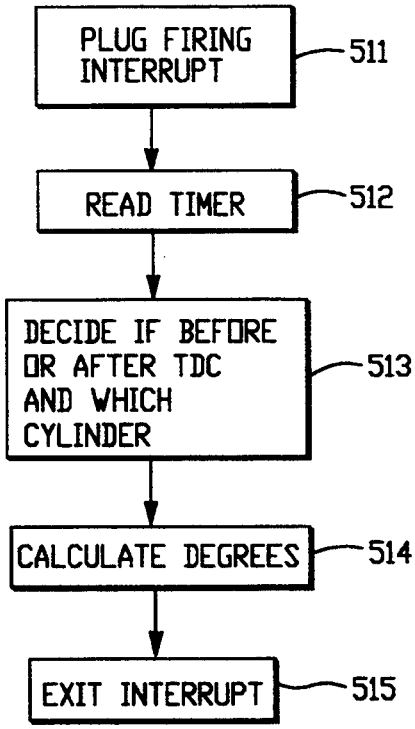

Reference is made to the firmware functional flow diagrams of FIGS. 5A–C which are supplied as examples of the minimum performance computer programs for the invention. They are simplified explanations that ignore processor dependant steps and are not to be taken as the only nor possibly the best ways to implement the invention.

The primary purpose of the computer unit is to respond to the signals from the TDC sensor and the ignition pickup, measure elapsed time, and to accomplish the mathematical and logical processes to determine rotational time, record point of firing, calculate firing point in degrees relative to TDC and display the resultant data. The choice as to the particular microprocessor is based upon the integration level (the number of additional hardware functions included) of a processor and how useful those functions are to this application and how well a particular processor will survive in the physical environment.

The computer unit integrates the electronic signals from the TDC sensor and the ignition firing sensor and the timer for determining the time of ignition relative to the engine rotational TDC and calculating the difference therebetween and converting that difference to degrees of crankshaft rotation before or after TDC. The timer is an integral unit of the microprocessor.

Main Program—FIG. 5A

Start 501—Commence executing the program, the starting point.

Initialize all registers and structures 502—Set the initial values for all timers, perform read and write operational test of internal RAM and clear RAM to all O's. Setup interrupt structure, enabling desired interrupt inputs, and assign interrupt priorities. Normal procedures.

Clear display 50—Clear display to all 0's. This avoids showing any erroneous information until the program determines there is meaningful data to display. Normal procedure.

Perform hardware check and diagnostics 503—Perform a check-sum on the program stored in ROM, check all inputs and outputs for correct logic level, and verify functioning of the timer. If any of these checks fail, the program is not run any further and the display is put to all 9's, indicating a failure.

Update display 504—The current available information is displayed. This is a time multiplexed display system; starting at the first digit, every two milliseconds the next digit is displayed. The blink rate of any one digit is high enough that the eye sees a constant digit with no perceived blinking.

Perform numeric analysis on data 505—If valid data has been collected and successfully processed by one of the interrupt routines, this section of code handles all calculations that do not have to be done in "real time." These cover such functions as averaging the RPM reading and/or the firing degree angle to remove or reduce fluctuations. Additionally the variance in RPM and/or the firing angle can be measured for engine performance analysis. Monitoring the dwell of the ignition is easily added since that information is also available. Adding additional functions such as monitoring battery voltage or engine temperature is likewise easily done.

Program loops back to update display and cycles through endlessly.

Interrupt Sequence—FIG. 5B

Interrupt from TDC sensor 507—When this interrupt occurs, whatever code is being run at this time is halted and process states are saved and this code sequence starts executing.

Save timer and check if value is valid 508—The timer is halted and the value is saved in RAM, timer is cleared and re-started. The saved value is checked for validity, if the count value is too high, the engine is deemed to be starting or stopping and no calculations or evaluations are made. Additionally if the time is too small, it is defined as an erroneous interrupt generation and no calculations or evaluations are made.

Calculate RPM 509—If the timer reading is valid, then the RPM is calculated from the timer value and that calculated value is saved. Flag is set to indicate to the main loop that this RPM is valid.

Exit interrupt 510—The state of the machine value that was saved at the start of this interrupt sequence is restored, and the program resumes execution from where it was suspended.

Plug Firing Interrupt—FIG. 5C

Plug firing interrupt 511—When interrupt occurs, the section of program code that is executing is halted and the state of the machine value is saved and program execution starts here immediately.

Read timer 512—The timer is halted, the value is read, and the timer is then restarted. This only takes three microseconds and is a constant so it can be added to the timer value by the TDC interrupt code.

Determine if before or after TDC and which cylinder 513—If the engine is running, the ignition firing for the desired cylinder will be within ±90 degrees of engine rotation. Ninety degrees is $\frac{1}{4}$ of a crankshaft revolution and $\frac{1}{8}$ of a camshaft rotation. If the timer read is less than $\frac{1}{8}$ of the TDC saved time, the firing was for the required cylinder and occurred after TDC and this relationship is flagged. If the timer read value is greater than $\frac{7}{8}$ of the TDC saved time, the firing is also for the required cylinder and occurred before TDC and this relationship is flagged. If neither of the foregoing checks are true, then this firing interrupt is treated as occurring for another cylinder and is ignored. This has to be done because the standard ignition system on a Harley-Davidson fires both plugs at the same time and is called a dual-fire ignition system. The ignition magnetic pickup can be on either plug wire and will generate the same signal. Single-fire ignition systems are an after market device, and only fire one plug at a time just like an automotive engine. As can be seen, this algorithm works for either type of ignition system and does not need to know which type of ignition system it is. This algorithm can be modified to allow calculations to be made on the other cylinder firings since all that information is available, but there usually is no way to change the firing of just one cylinder and not both, so this information is if little use unless a special type of ignition system is used that allows each cylinder's firing point to be changed independently.

Calculate degrees 514—If the measured value is a desired cylinder's firing, then the camshaft revolution time is divided by 720 to determine the amount of time per degree of crankshaft rotation. This value is then divided into the firing time if after TDC, or it is divided into the difference of RPM time and firing time if before TDC. This result is the number of degrees, calculated to 0.1 degrees, that the plug firing occurred relative to TDC. This value is saved for display.

Exit interrupt 515—Return to former code execution in the same manner as the previous interrupt routine of FIG. 5B.

THE CIRCUITRY

The present embodiment is a compromise of size, power consumption, and expense and represents what is felt to be the best combination to effectuate the function of the invention at the present time. As the state of the art progresses, the preferred embodiment will undoubtedly change with the art, but the functionality will remain.

Figure 6:
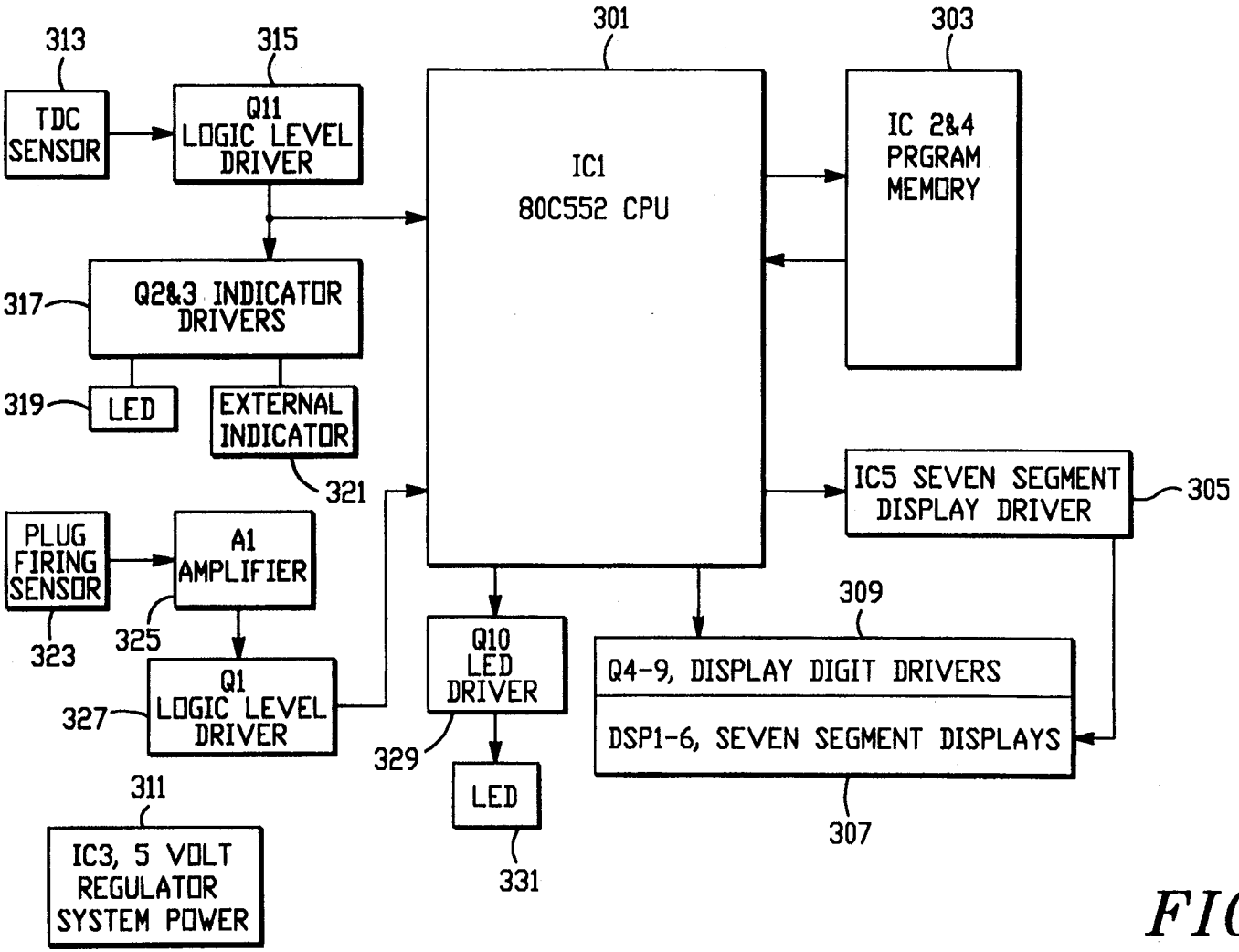
FIG. 6 is a block diagram of the electronic circuitry of the present invention.

Reference is made to FIG. 6 of the drawings for an understanding of the electronic circuitry. The present invention utilizes a Signetics/Phillips 80C552 microprocessor 301 which includes an internal timer having a 12 MHz crystal giving it one microsecond resolution time measurements. The microprocessor has an internal RAM (Random Access Memory) field, four timers, an interrupt control structure, logical and mathematical functions. It is known as a high integration micro-controller for embedded applications.

The program memory 303 includes an octal latch, such as industry standard generic part number 74HC573. It is a low order address latch for proper addressing of the program memory device. A 64K-byte memory chip, such as industry standard generic part number eprom 27C512, contains the program storage.

A seven-segment display decoder and driver 305, such as industry standard generic part number 74HC4511, takes as its input the binary code for the numbers 0 through 9 and provides drive to the correct segment of a six-unit, seven-segment LED display 307. The microprocessor could perform the decoding function but its output/input pins do not have the drive capability needed, 40 to 50 milliamps.

Devices Q1–Q11 are Field Effect Transistors (FET devices), such as industry standard generic part number 2N7000, which are used in a digital mode. This is "saturated logic" as opposed to linear operation. The use of the device is as a switch: the device is either turned on or off and operation in the linear mode is not desired nor intended. Q4 through Q9 are display digit drivers 309 used to select the individual seven-segment display that is to be driven at any particular moment. This allows the multiplexing of the displays requiring only one display driver 305.

A voltage regulator 311, such as industry standard generic part number 7805, reduces the power voltage to +5 volts, keeps it constant, and powers the whole system. The gate drive for the FETs is 0 volts for "off" or +5 volts for "on" whereby they act as voltage controlled switches.

The signal from the TDC sensor 313, either optical or switch, is converted to "logic levels" by the logic level driver 315 and the indicator drivers 317. The switch is the auxiliary points of the first embodiment of the invention illustrated by FIG. 1. When Q2 is off, the gate voltage is below 2 volts, and when the gate voltage is above 3 volts, the device is fully turned on. The signal voltage from the TDC detectors is either 0 or 5 volts, depending on the state of the sensor, and guarantees that the device will either be on or off.

The LED driver, Q2 of 317, is used to turn on or off the LED display 319 which indicates the presence of the TDC signal. The output of Q11 is also applied to an interrupt input pin of the microprocessor. This interrupt routine halts and reads and saves the rotational time measurement counter, then the counter is cleared and restarted. The time for this process to complete is a constant and is compensated for. This function covers the range of 1-393210 microseconds, which results in a possible RPM measurement range of 120,000,000 down to 305 RPM, which is above any possible RPM and below any reasonable engine idle speed.

Additionally, the output of Q11, logic level driver 315, operates Q2 and Q3 in parallel. Q3 grounds J3-Pin 1 providing a current path to ground to energize an external indicator 321, such as a 12-volt bulb, which has its other side connected to +12 volts. Every time the LED is energized, the external indicator will also be on.

The signal from the plug firing sensor 323 is amplified by the operational amplifier 325, such as industry standard generic part number TLC274. The circuitry includes a positive pulse detector and stretcher which converts the 3–5 microsecond pulse from the inductive pickup into a 0.5 millisecond pulse which is amplified. The input of the op-amp is biased negative to cause this circuitry to act as a level detector and amplifier. If the input signal is not large enough, above 2.5 volts, the output from the op-amp remains low, keeping the logic level driver 327 turned off. This functions to capture the initial firing pulse and prevents responses to subsequent peaks from the ignition "ringing" and keeps the noise immunity high. An input signal of 2.8 volts guarantees that the logic level driver Q1 will be turned on fully, or act as a closed switch. The interrupt inputs of the microprocessor are "edge triggered," that is, they respond to the transition from +5 to 0 volts and do not respond to a steady level or the transition from 0 volts to +5 volts.

The LED driver, Q10 of 329, turns on and off the LED of display 331, which is the decimal point in the seven-segment display 307, as it is needed.

FUNCTIONAL OPERATION

The signal from the ignition inductive pickup 323 is amplified by the operational amplifier 325 and is converted to logic levels by Q1, the output of which is applied to an interrupt input of the microprocessor. The function implemented reads the present value of the rotational time counter and saves it.

After the foregoing functions are completed, another function is implemented which calculates engine RPM using the mathematical formula of $(1/\text{Time})\times 60\times 2$ which is the reciprocal of rotational time which gives the number of rotations per second multiplied by 60 to generate the RPM of the ignition drive shaft and multiplied by 2 to yield the engine crankshaft RPM (the ignition drive shaft turns at one-half the crankshaft rate). If the reading is below a chosen limit, the engine is considered to be starting or quitting (400 RPM has been chosen as a reasonable figure). In either event, no further calculations will be done with the data. If the engine speed is fast enough, the RPM data is stored for display; otherwise, a "0" is stored.

The next function checks the data stored by the ignition signal and determines if it occurred within 90 degrees of engine rotation of the TDC signal. This qualification is done to preclude false readings that could result if the ignition pickup is on the wrong spark plug wire. If this check is passed, then the next function is performed.

This next function establishes the relationship between engine rotational time and degrees of mechanical angular movement by dividing the engine rotational time by 360 to find the amount of time per degree of rotation. This relationship is then used to convert the data saved by the ignition function into degrees of rotation, plus or minus (before TDC or after TDC). This conversion is saved for display.

The display function is based on a timer and is used purely to operate the seven-segment displays 307. The display function will be unique to the type of display chosen and to what data is selected for display. For this implementation, a minimum of three digits of RPM and three digits of ignition degrees has been selected with a single LED to indicate before or after TDC reading.

The four-bit decimal code for each digit is converted into its corresponding seven-segment display pattern by the display driver 305. Each digit is displayed for two milliseconds, as controlled by Q4-9, implementing a time division multiplexing scheme.

CONCLUSION

The present invention eliminates the need for trial and error setting of Harley-Davidson motorcycle engine ignition timing, and it provides a monitoring device which can be left on the motorcycle during operation for continuous readout of the engine operating condition. It provides the additional benefit of functioning as a tachometer concurrently or alternatively while determining spark advance timing.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An ignition timing device for a Harley-Davidson motorcycle engine utilizing a breaker points spark plug ignition system which is housed in a nose cone and driven by an ignition drive shaft comprising a TDC sensor including an accessory pair of breaker points actuated by the ignition drive shaft which indicate when the engine is rotated so that a piston is at TDC and a means for generating an electronic signal when the accessory breaker points indicate TDC, an ignition firing sensor for determining when the spark plug associated with said piston fires and for generating an electronic signal to indicate said firing, a timer for determining the rotational time of the engine, a computer unit for integrating the electronic signals from the TDC sensor and the ignition firing sensor and the timer for determining the time of ignition relative to the engine rotational TDC and calculating the difference there between and converting said difference to degrees of crankshaft rotation before or after TDC, and a display for indicating said difference in degrees of rotation.

2. The ignition timing device of claim 1 wherein the accessory breaker points and the ignition breaker points are mounted on an adjustable base plate secured to said nose cone and are individually angularly adjustable on said base plate with respect to said ignition drive shaft.

3. The ignition timing device of claim 1 wherein said computer unit calculates ignition dwell, uncertainty in the timing, and RPM, and said display includes means for indicating said information.

4. The ignition timing device of claim 1 including sensors for detecting battery voltage and preselected engine temperatures, and said display includes means for indicating said information.

5. The ignition timing device of claim 1 wherein an edge sensitive sensor and indicator are utilized to signal the onset of TDC.

6. The ignition timing device of claim 1 wherein the minimum display includes a three-digit LED array which can be switched to alternately display RPM or spark advance.

7. An ignition timing device for a Harley-Davidson motorcycle engine utilizing an electronic or magneto spark plug ignition system which is housed in a nose cone and is driven by an ignition drive shaft comprising an accessory timing disk which is secured to the ignition drive shaft and has a radial slot formed therein registered to the TDC of a piston of said engine, an optical sensor secured to a removable attachment which is temporarily secured to said nose cone, said optical sensor positioned to sense optical radiation through said slot in said disk, said optical sensor generating an electronic signal when said slot is aligned therewith, an ignition firing sensor for determining when the spark plug associated with said piston fires and for generating an electronic signal to indicate said firing, a timer for determining the rotational time of the engine, a computer unit for integrating the electronic signals from the TDC sensor and the ignition firing sensor and the timer for determining the time of ignition relative to the engine rotational TDC and calculating the difference there between and converting said difference to degrees of crankshaft rotation before or after TDC, and a display for indicating said difference in degrees of rotation.

8. The ignition timing device of claim 7 wherein the removable attachment includes an expandable and collapsible sleeve which can be inserted into the outboard end of said nose cone and engaged therewith by expanding said sleeve.

9. An ignition timing device for a Harley-Davidson motorcycle engine utilizing an electronic spark plug ignition system which is housed in a nose cone and is driven by an ignition drive shaft comprising an accessory timing cup which is secured to the ignition drive shaft and has a slot formed in the wall of said cup registered to the TDC of a piston of said engine, an optical sensor unit secured to said nose cone and positioned to sense optical radiation through said slot in said cup wall, said optical sensor generating an electronic signal when said slot is aligned therewith, an ignition firing sensor for determining when the spark plug associated with said piston fires and for generating an electronic signal to indicate said firing, a timer for determining the rotational time of the engine, a computer unit for integrating the electronic signals from the TDC sensor and the ignition firing sensor and the timer for determining the time of ignition relative to the engine rotational TDC and calculating the difference there between and converting said difference to degrees of crankshaft rotation before or after TDC, and a display for indicating said difference in degrees of rotation.

10. The ignition timing device of claim 9 wherein the magnetic sensor of the electronic ignition is mounted on a stand off base plate disposed further outboard in the nose cone than the standard electronic ignition base plate and the accessory timing cup and optical sensor unit are mounted inboard of the stand off base plate in the nose cone.

11. An engine ignition timing device for Harley-Davidson motorcycle engines having an ignition system housed in a nose cone and driven by an ignition drive shaft comprising a TDC sensor secured to the ignition drive shaft and which generates an electronic signal when a piston of an engine is at TDC, an ignition firing sensor for determining when the spark plug associated with said piston fires and for generating an electronic signal to indicate said firing, a computer unit for integrating the electronic signals from the TDC sensor and the ignition firing sensor and the timer for determining the time of ignition relative to the engine rotational TDC and calculating the difference there between and converting said difference to degrees of crankshaft rotation before or after TDC, said computer including the following minimum performance programs:

main program:
- start,
- initialize all registers and structures, clear display,
- perform hardware check and diagnostics,
- update display,
- perform numeric analysis on data,
- loop back and update display endlessly;

interrupt sequence:
- interrupt from TDC sensor,
- save time and check if value is valid,
- calculate RPM,
- exit interrupt;

plug firing interrupt:
- plug firing interrupt,
- read timer,
- determine if before or after TDC and which cylinder,
- calculate degrees,
- exit interrupt; and a display for indicating the results of said numerical analysis of the data provided by the sensors.

12. The method of operation for an ignition timing device for a Harley-Davidson motorcycle engine comprising obtaining a signal from a sensor which indicates a selected piston of the motorcycle engine is at TDC and delivering said signal to a high-integration microprocessor, obtaining a signal from an ignition inductive pickup which indicates the firing of a spark plug associated with said selected piston which is approximately at TDC, amplifying the signal from the plug firing sensor and converting it to logic levels by an FET, the output of which is applied to an interrupt input of the microprocessor, reading the present value of the rotational time counter of the microprocessor and saving it, calculating engine RPM mathematically and, if the reading is below a chosen limit, storing a zero; and if the engine speed is above said limit, the RPM data is stored for display, checking the data stored by the ignition signal and determining if it occurred within 90 degrees of engine rotation of the TDC signal, if the engine signal did occur within 90 degrees of engine rotation of the TDC signal, the relationship between engine rotational time and the degrees of mechanical angular movement are established by dividing the engine rotation time by 360 to determine the amount of time per degree of rotation, said relationship being used to convert the data saved by the ignition function into degrees of rotation plus or minus, before TDC or after TDC, and the conversion is saved for display, displaying the function on at least a three-digit, seven-segment display with at least a single LED to indicate before or after TDC.

* * * * *